US005871145A

United States Patent [19]

Hermann et al.

[11] Patent Number: 5,871,145

[45] Date of Patent: Feb. 16, 1999

[54] ONE-PIECE BLANK FOR A FOLDING BOX

[75] Inventors: Manfred Hermann, Korb; Eberhard Krieger, Weinstadt; Juergen Nowak, Freiburg, all of Germany

[73] Assignee: Robert Bosch GmbH, Stuttgart, Germany

[21] Appl. No.: 809,322

[22] PCT Filed: Jul. 11, 1996

[86] PCT No.: PCT/DE96/01249

§ 371 Date: Mar. 19, 1997

§ 102(e) Date: Mar. 19, 1997

[87] PCT Pub. No.: WO97/03886

PCT Pub. Date: Feb. 6, 1997

[30] Foreign Application Priority Data

Jul. 19, 1995 [DE] Germany ..... 195 26 335.9

[51] Int. Cl.[6] ..... B65D 85/20; B65D 85/12

[52] U.S. Cl. ..... 229/120.21; 206/443; 206/528; 229/120.18

[58] Field of Search ..... 229/120.13, 120.14, 229/120.15, 120.18, 120.21; 206/443, 485, 528

[56] References Cited

U.S. PATENT DOCUMENTS

| | | | |
|---|---|---|---|
| 1,337,091 | 4/1920 | Neski | 206/443 |
| 1,686,273 | 10/1928 | Goodspeed . | |
| 2,069,997 | 2/1937 | Carr | 229/120.18 |
| 2,128,197 | 8/1938 | Weil | 229/120.18 |
| 2,643,811 | 6/1953 | Bolding | 229/120.18 |
| 3,036,754 | 5/1962 | Kleingers, Jr. . | |
| 3,115,247 | 12/1963 | Hauser | 206/528 |
| 3,326,444 | 6/1967 | Farquhar et al. | 229/120.18 |
| 3,390,783 | 7/1968 | Quackenbush, Jr. | 206/443 |
| 3,921,895 | 11/1975 | Ziche | 206/528 |
| 5,121,838 | 6/1992 | Dickie | 206/485 |
| 5,402,889 | 4/1995 | Hermann et al. | 206/443 |

FOREIGN PATENT DOCUMENTS

| | | |
|---|---|---|
| 2453309 | 5/1976 | Germany . |
| 4438699 | 10/1994 | Germany . |
| 394033 | 11/1965 | Switzerland . |

*Primary Examiner*—Gary E. Elkins
*Attorney, Agent, or Firm*—Edwin E. Greigg; Ronald E. Greigg

[57] ABSTRACT

A folding box for packing articles in which the folding box has a one-piece parallelepiped body. An insert for the articles and a compartment for a package leaflet is disposed in the body. The one-piece blank of the folding box is embodied such that the folding box can be produced with only a few folding operations. This is attained by a special disposition of an insert on a longitudinal gluing flap.

21 Claims, 10 Drawing Sheets

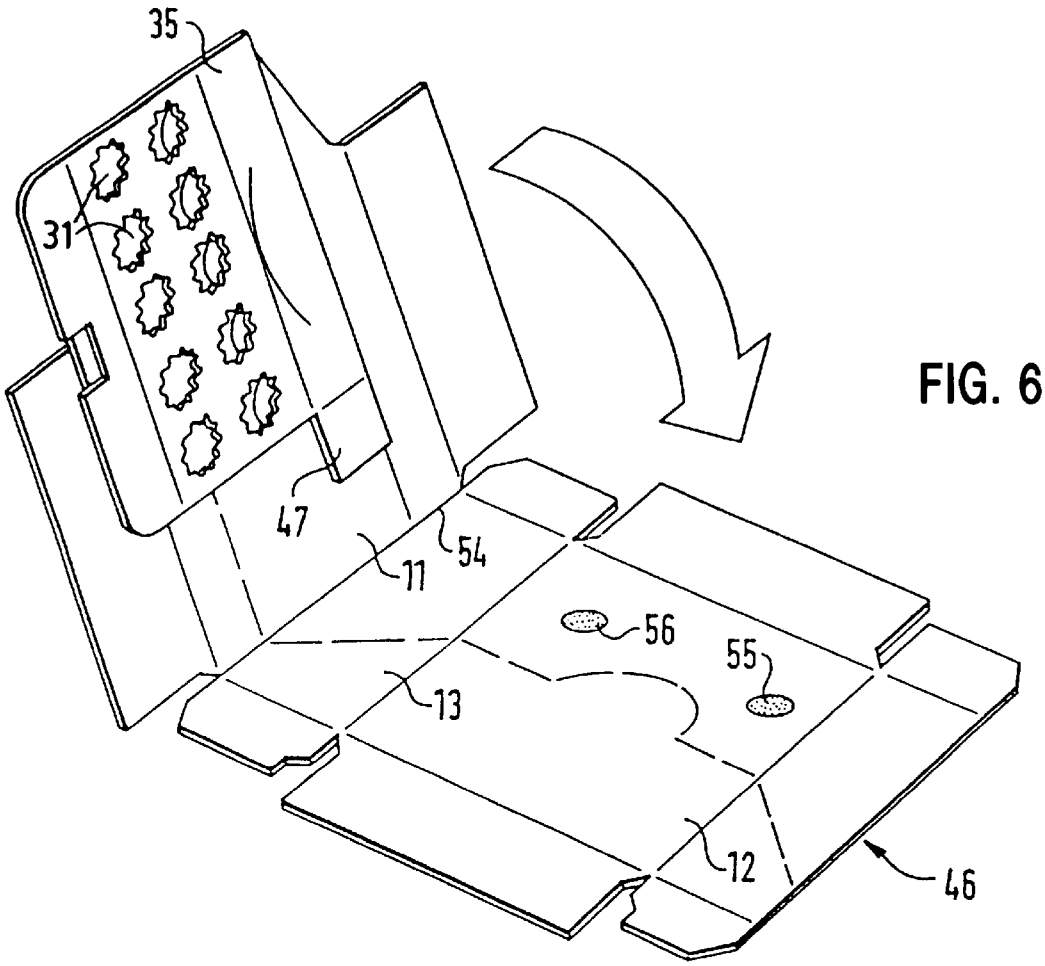
FIG. 6
FIG. 7
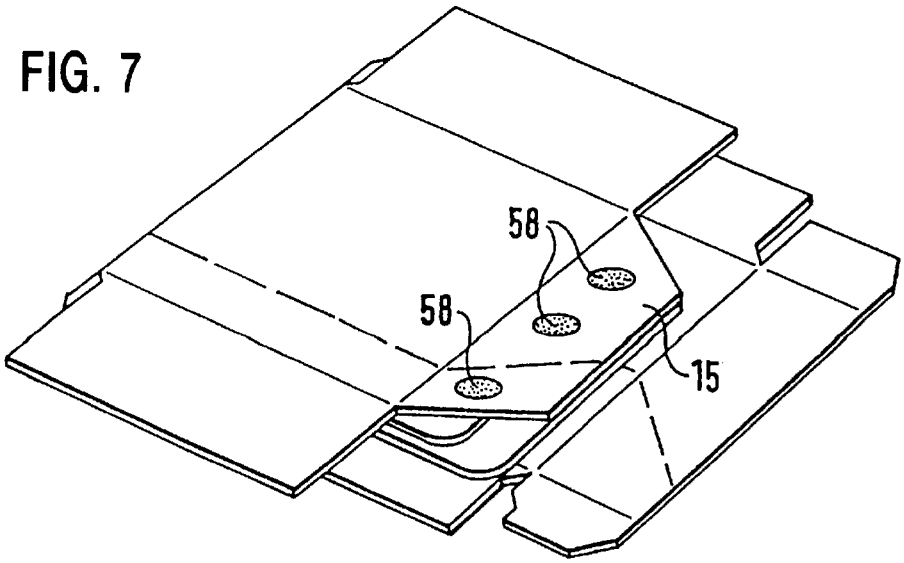

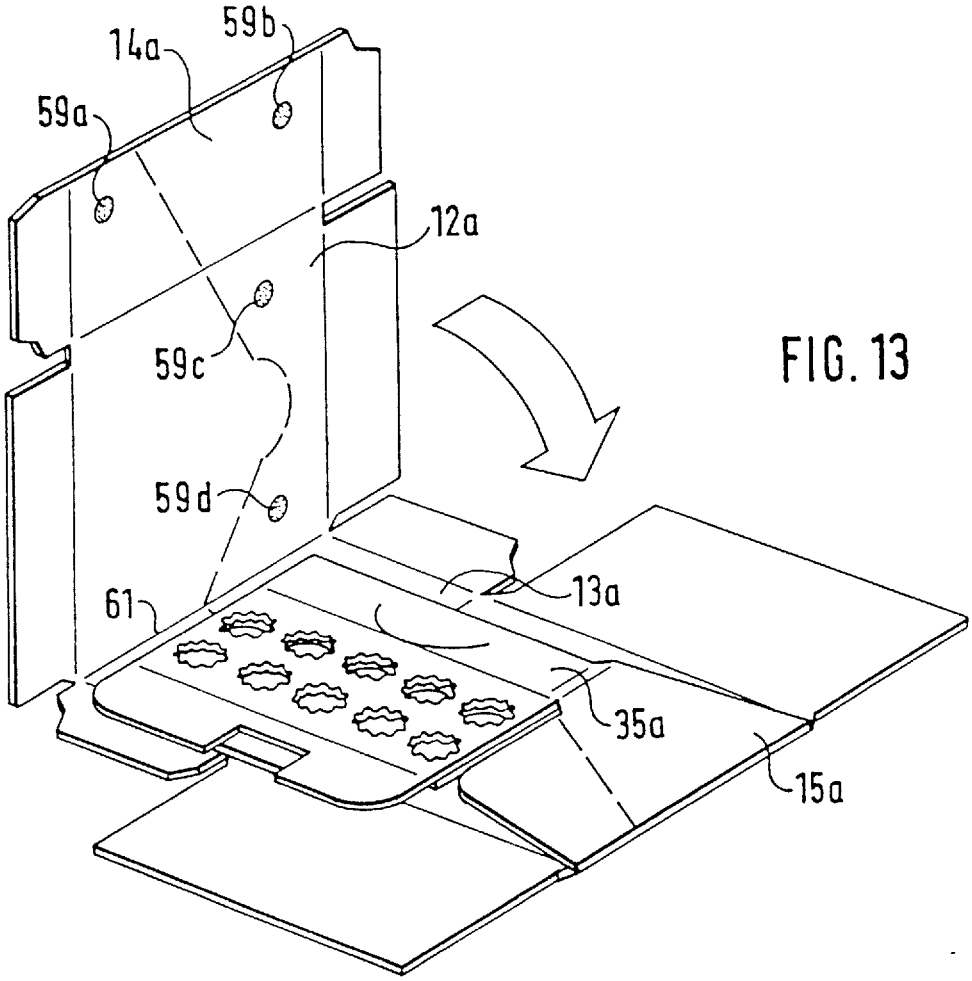
FIG. 13
FIG. 14
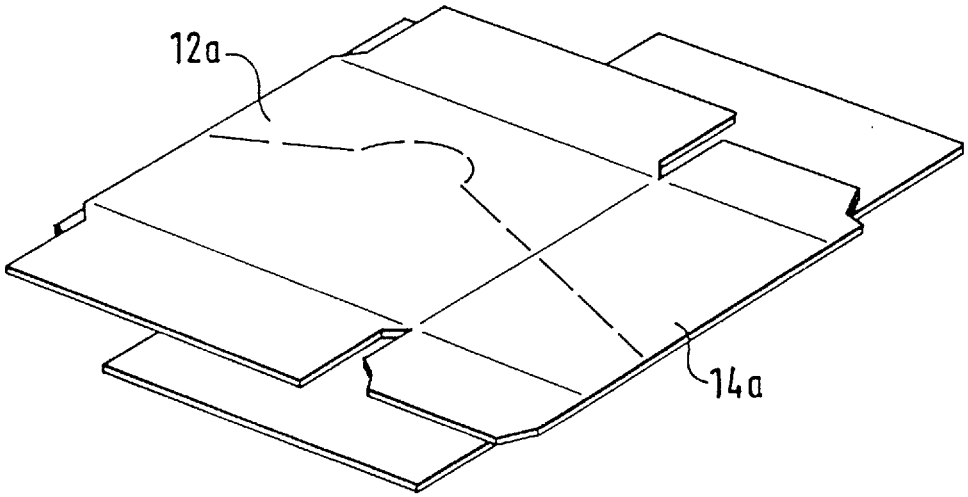

ONE-PIECE BLANK FOR A FOLDING BOX

PRIOR ART

The invention is based on a one-piece blank for a folding box for packaging such articles as ampules, small bottles, vials or the like. In a folding box of the present Applicant, known from German Patent Disclosure DE 43 09 036 A1, now U.S. Pat. No. 5,402,889, it is possible to make the blank for the folding boxes in one piece. At the folding box factory, this blank can be folded, glued and flattened. The folding boxes laid flat are then shipped in stacks to the packing plant, where taking up little space they are kept on hand and then erected as needed with a cartoning machine, equipped with the articles to be packed, and closed. A disadvantage of this otherwise satisfactory folding box is that for gluing and folding on conventional gluing and folding machines, it requires multiple passes, since the gluing and folding machine allows only a certain number of folding operations per gluing pass. This not only means major effort and expense for manipulation but also makes for a relatively low yield in such machines.

U.S. Pat. No. 4,160,502 also discloses a folding box, whose insert extends at right angles to the long sides of the side walls. German utility model DE 92 14 914 U1 shows a folding box with closure flaps folded over onto one another and inseparably joined together; the flaps have a perforation with which a lid part can be folded open from a bottom part.

ADVANTAGES OF THE INVENTION

The one-piece blank according to the invention for a folding box has the advantage over the prior art that the folding box made from the blank can be produced with only a few folding operations, so that all the folding operations can be done during one pass for gluing on conventional gluing and folding machines. The result is a short production time for the folding box and low expense for manipulation, so that the folding box can be produced especially economically.

Other advantages and advantageous features of the one-piece blank according to the invention for a folding box will become apparent from the claims and the description. By varying the dimensions of the tabs that form the partition and are joined to the curtain walls, the compartment, for instance for a package leaflet, can be adapted to the size of the package leaflet. An especially advantageous opening and closure and a good overview of the articles located in the folding box can be attained if the upper part of the tube is embodied as capable of being folded open along a perforation line.

BRIEF DESCRIPTION OF THE DRAWINGS

One exemplary embodiment of the invention is shown in the drawing and will be described in further detail in the ensuing description.

FIGS. 4–9 show the operation of folding the folding box from the blank of FIG. 3;

FIGS. 11–14 show the operation of folding the folding box from a blank of FIG. 10, all the drawing figures being shown as perspective views.

DESCRIPTION OF THE EXEMPLARY EMBODIMENT

Figure 1:
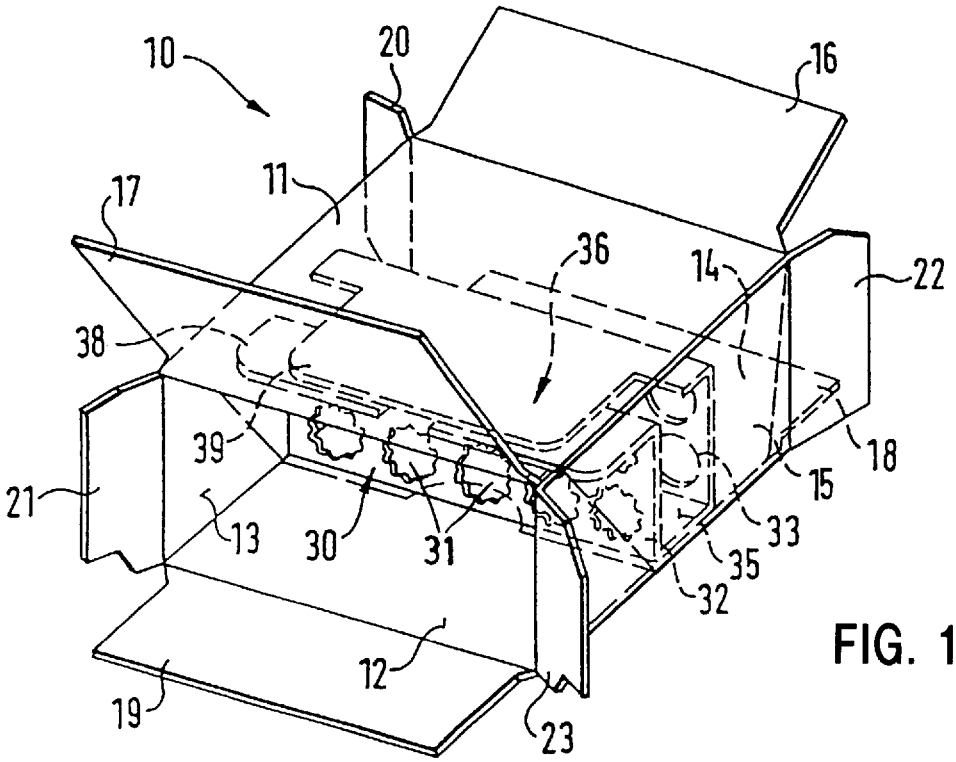
FIG. 1 shows a folded-open, unclosed folding box.

The parallelepiped folding box (FIG. 1), made of a stiff packaging material, preferably cardboard, has a tubular body 10 with two long side walls 11, 12 parallel to one another and two short side walls 13, 14 parallel to one another. One short side wall 14 is glued on its inner surface to a trapezoidal longitudinal gluing flap 15 pivotably joined to the long side wall 11. The end faces of the body 10 on the bottom and top sides are closable by means of closure flaps 16–23 that are pivotably joined to the side walls 11–14, folded over into the respective end faces, and glued together.

Figure 2:
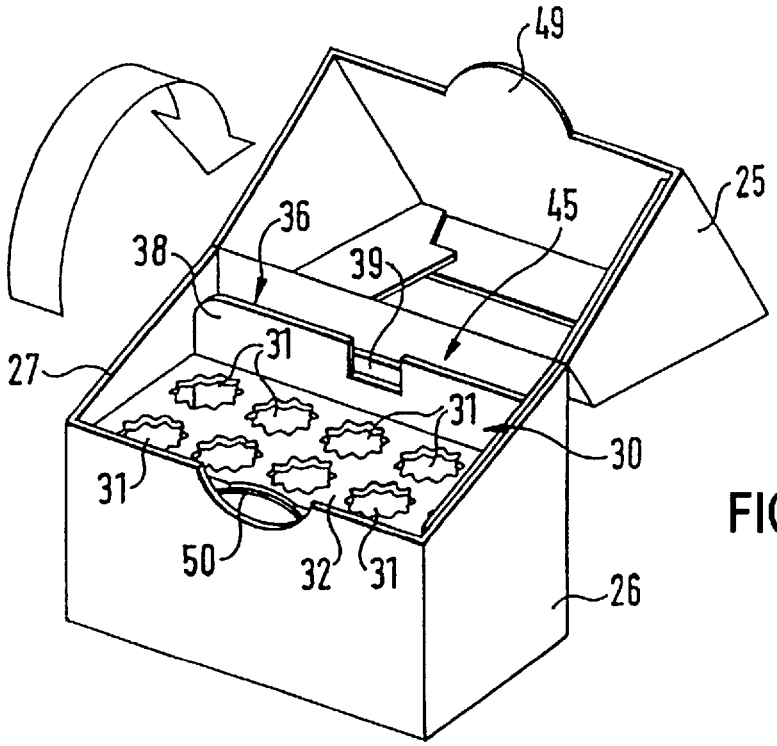
FIG. 2 shows a folding box in the flat folded-open state.
Figure 3:
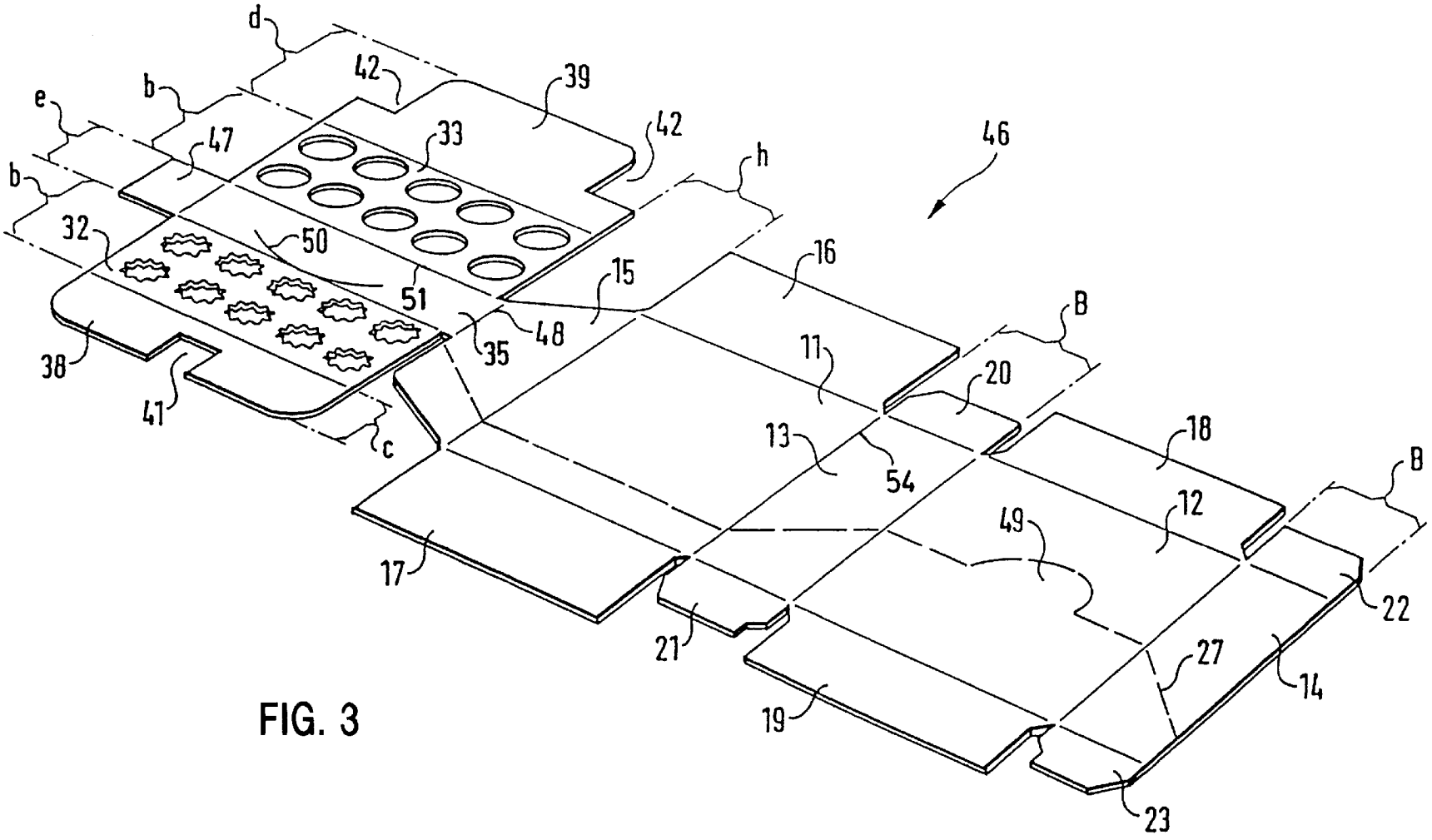
FIG. 3 shows a first blank for the folding box of FIGS. 1 and 2.

FIGS. 2 and 3 will now be described: To fold the top part 25 open from the bottom part 26, the folding box is equipped with a perforation 27. The perforation 27 will be described in further detail hereinafter. An insert 30 with openings 31 for form-fitting reception of articles such as ampules, small bottles, vials or the like that are vulnerable to shock is disposed in the bottom part 26.

The insert 30 comprises two curtain walls 32, 33, which extend parallel to one another and at predetermined distances from the end faces of the body 10 in the bottom part 26. The curtain walls 32, 33, whose width b is less than the width B of the short side walls 13, 14 are joined to the long side wall 11 (see FIG. 3) via the longitudinal gluing flap 15 by means of a web 35 that joins the short side walls.

The height h of the longitudinal gluing flap 15 is also somewhat less than the width B of the short side walls 13, 14. This is necessary so that the folding box, in the glued but as yet unerected state, can be stored completely flat. Extending parallel to the web 35 is a partition 36, which is formed by two glued-together tabs 38, 39 pivotably joined to the respective long sides of the curtain walls 32, 33. The narrow tab 38, which has the width c, has a U-shaped cutout 41 in the middle, which is open on the side opposite the web 35. The wide tab 39, whose width d is approximately equivalent to the sum of the width c of the narrow tab 38 and the width e of the web 35, has an approximately rectangular cutout 42 on each of its corners remote from the curtain wall 33. Between the partition 36 and the long side wall 11, an insertion compartment 45 is formed, for instance for a package leaflet. It will be noted in addition that by varying the width b, the size of the partition 36 can be adapted to the size of the package leaflet, for instance.

The blank 46 of the folding box shown in FIG. 3 preferably comprises cardboard, as already noted at the outset. The cardboard is coated to be smooth on one side. The smoothly coated outside defines the external appearance of the folding box. In FIG. 3, the (rough) inside of the blank 46 is visible. The smooth outside is underneath. On the side of the web 35 opposite the longitudinal gluing flap 15, the blank 46 also has a further rectangular tab 47. In the folded state of the folding box, this tab 47 rests on the short side wall 13.

In FIG. 3, the disposition of the perforation 27 in the side walls 11–14 and in the longitudinal gluing flap 15 can also be seen. As in FIG. 2, the perforation 27 extends along the long side walls 11, 12 parallel to the long sides of the closure flaps 16–19. Conversely, in the short side walls 13, 14, the perforation 27 extends obliquely to the long sides of the closure flaps 20–23. In the longitudinal gluing flap 15, the perforation 27 also extends obliquely and it ends near the short end side 48 of the web 35. To enable the folded-open top part 25 to be reclosed with the bottom part 26, the perforation 27 in the long side wall 12 is embodied in the form of a semicircle or half ellipse. The thus-formed closure flap 49 can be inserted into a suitable curved notch 50 formed in the web 35.

Figure 4:
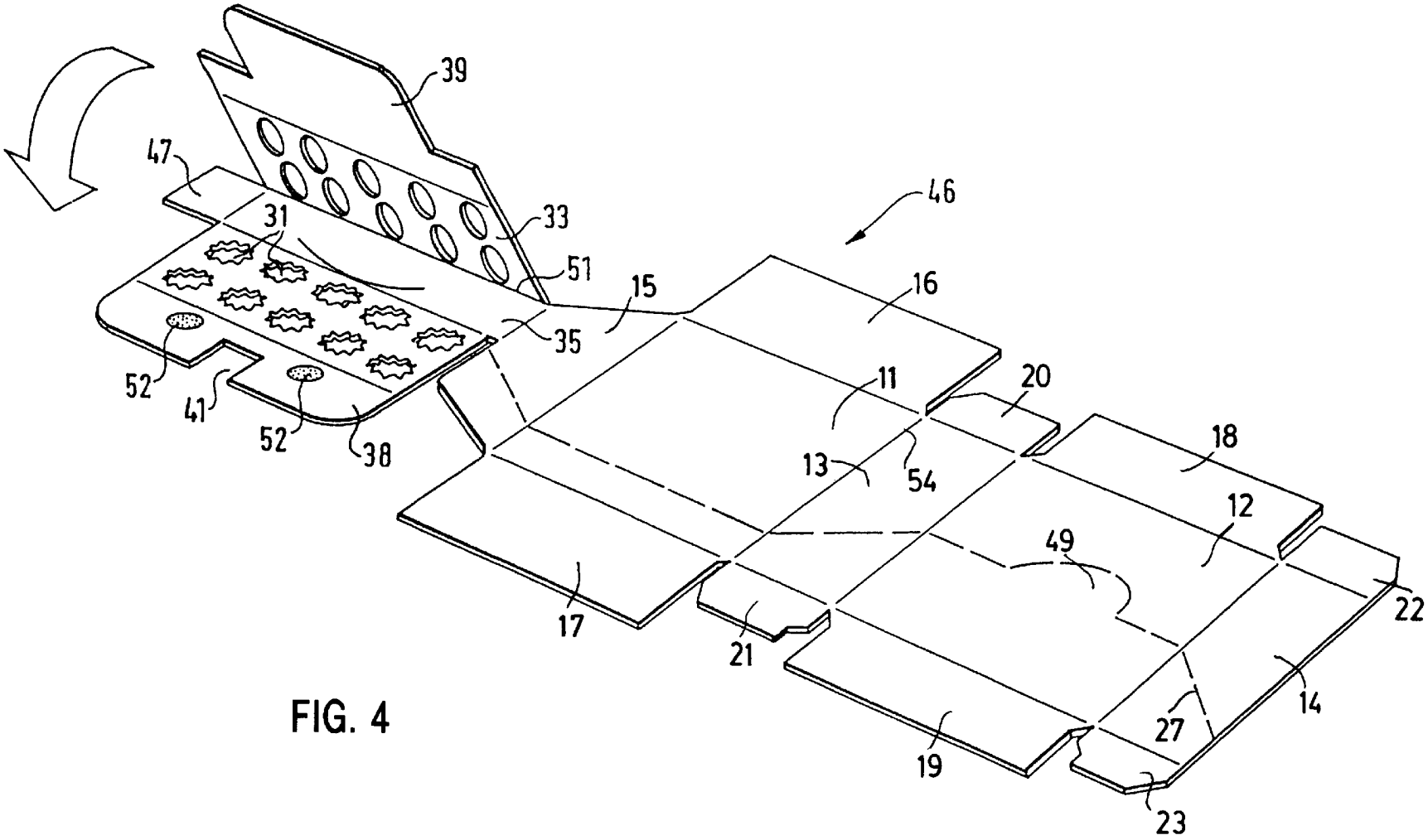
Figure 5:
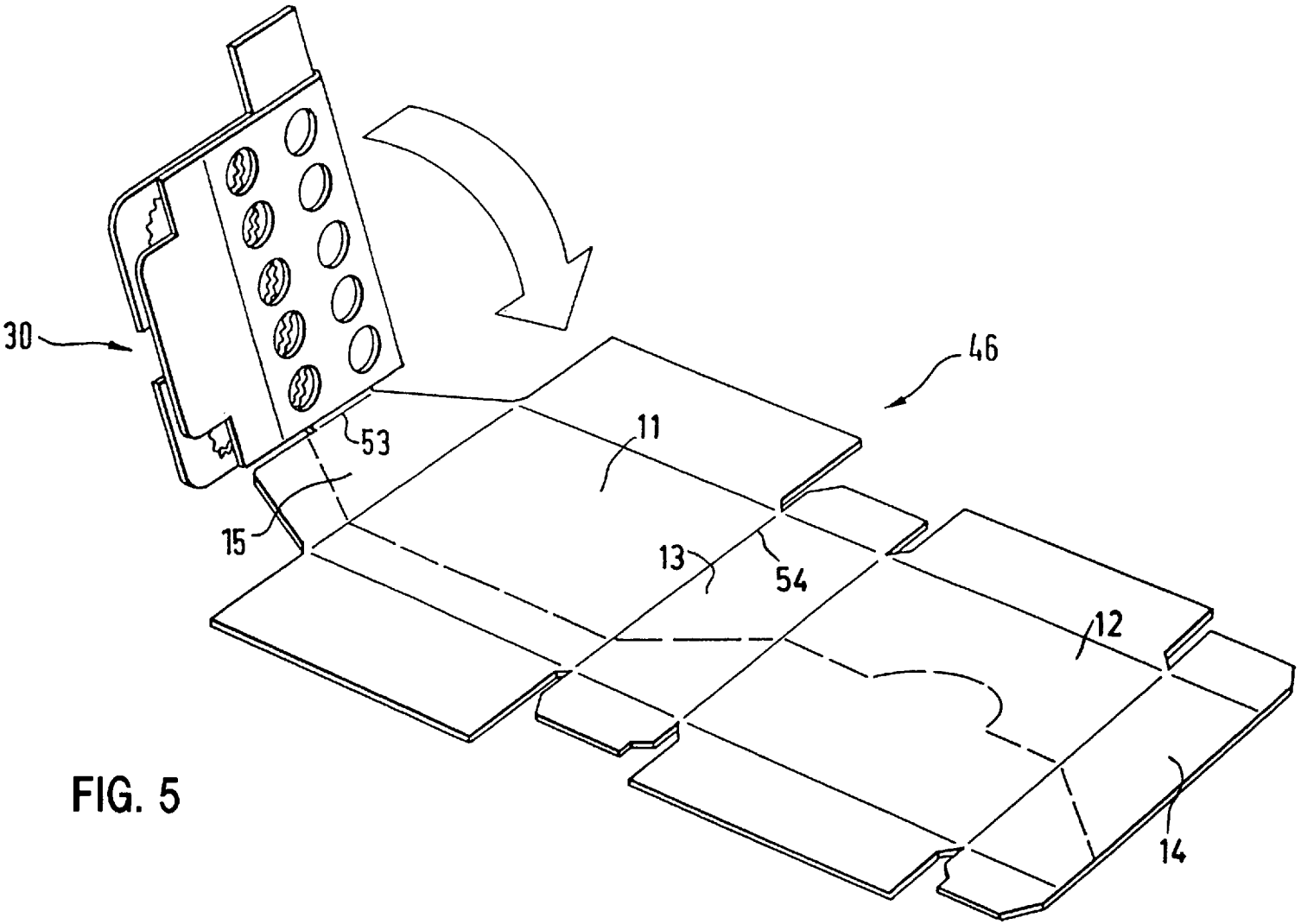
Figure 8:
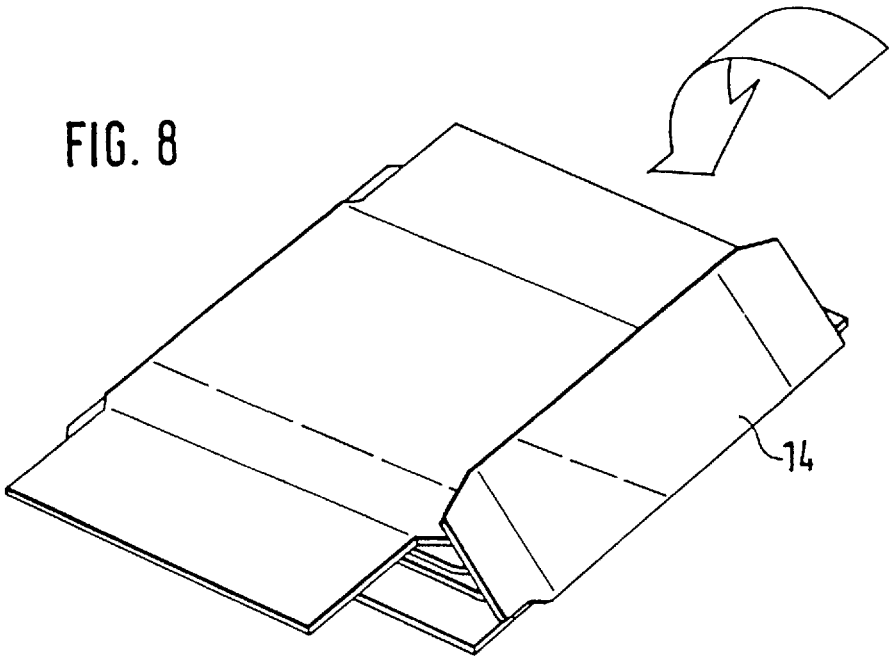
Figure 9:
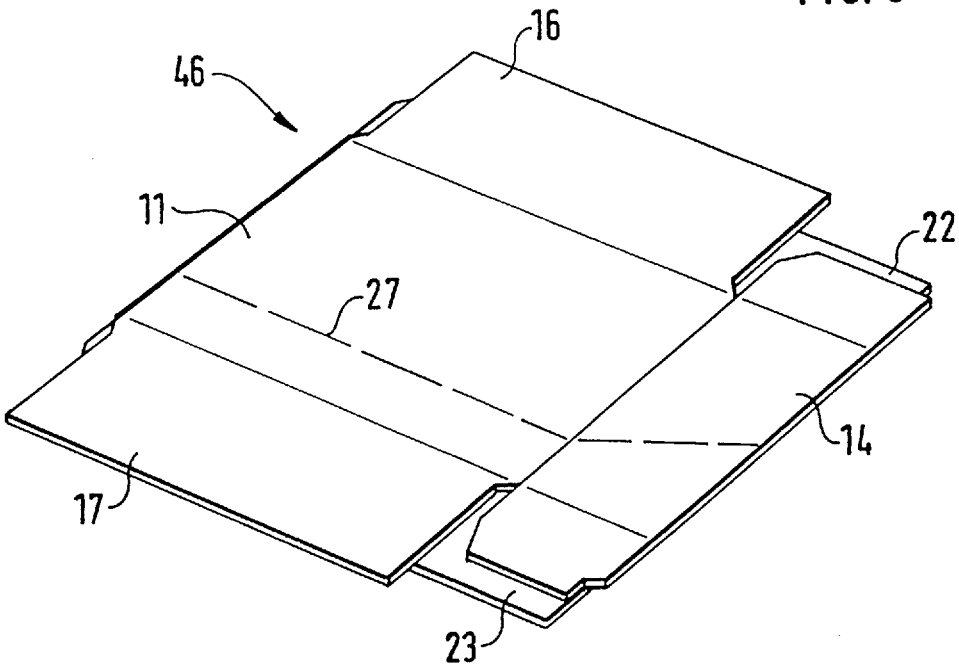

The folding box can be produced from the above-described blank 46 as follows (FIGS. 4–8): First, the curtain wall 33 together with the wide tab 39, is folded over flat along the fold line 51 on the web 35, and the wide tab 39 is joined (FIG. 4) by means of two glue dots 52 placed on the narrow tab 38 on both sides of the cutout 41. The tab 47 is held by means of a suitable device of the folding and gluing machine, so that the web 35 is positioned in the above-described operation of being folded over flat. Next, the insert 30 is folded over flat on the fold line 53 between the web 35 and the longitudinal gluing flap 15 (FIG. 5). After that, part of the blank 46 together with the insert 30 is folded over flat on the fold line 54 between the long side wall 11 and the short side wall 13. Two glue dots 55, 56 (FIG. 6) have been applied beforehand to the long side wall 12. The disposition of the glue dots 55, 56 is such that after the folding-over, the tab 47 rests loosely on the short side wall 13, and at the same time the web 35 and the long side wall 12 are joined. Finally, three glue dots 58 (FIG. 7) are applied to the longitudinal gluing flap 15, and the short side wall 14 is folded over against the longitudinal gluing flap 15 (FIG. 8). In this stage, the folding box is fully folded and glued (except for the gluing of the closure flaps 16–23), and it can be kept on hand in flattened form (FIG. 9). To fill the folding box with articles and a package leaflet at the packing plant, the flattened folding box can be further processed by means of cartoning machines, known per se.

The above-described folding box or its blank 46 has the advantage that it can be produced with only a few folding operations, so that it can be glued and folded in one gluing pass in conventional gluing and folding machines. This is made possible by the fact that the insert 30, via the narrow face end 48 of the web 35, adjoins the longitudinal gluing flap 15, and the long sides of the web 35 extend parallel to the long sides of the long side walls 11, 12. By means of the embodiment and disposition of the perforation 27 and the folding open of the folding box that thus becomes possible, good access and simple withdrawal of the articles disposed in the folding box are also made possible. At the same time, an advantageous effect for display purposes is obtained, as well as a good view of the articles in the folding box, and a simple reclosure capability is afforded by the closure flap 49.

Figure 10:
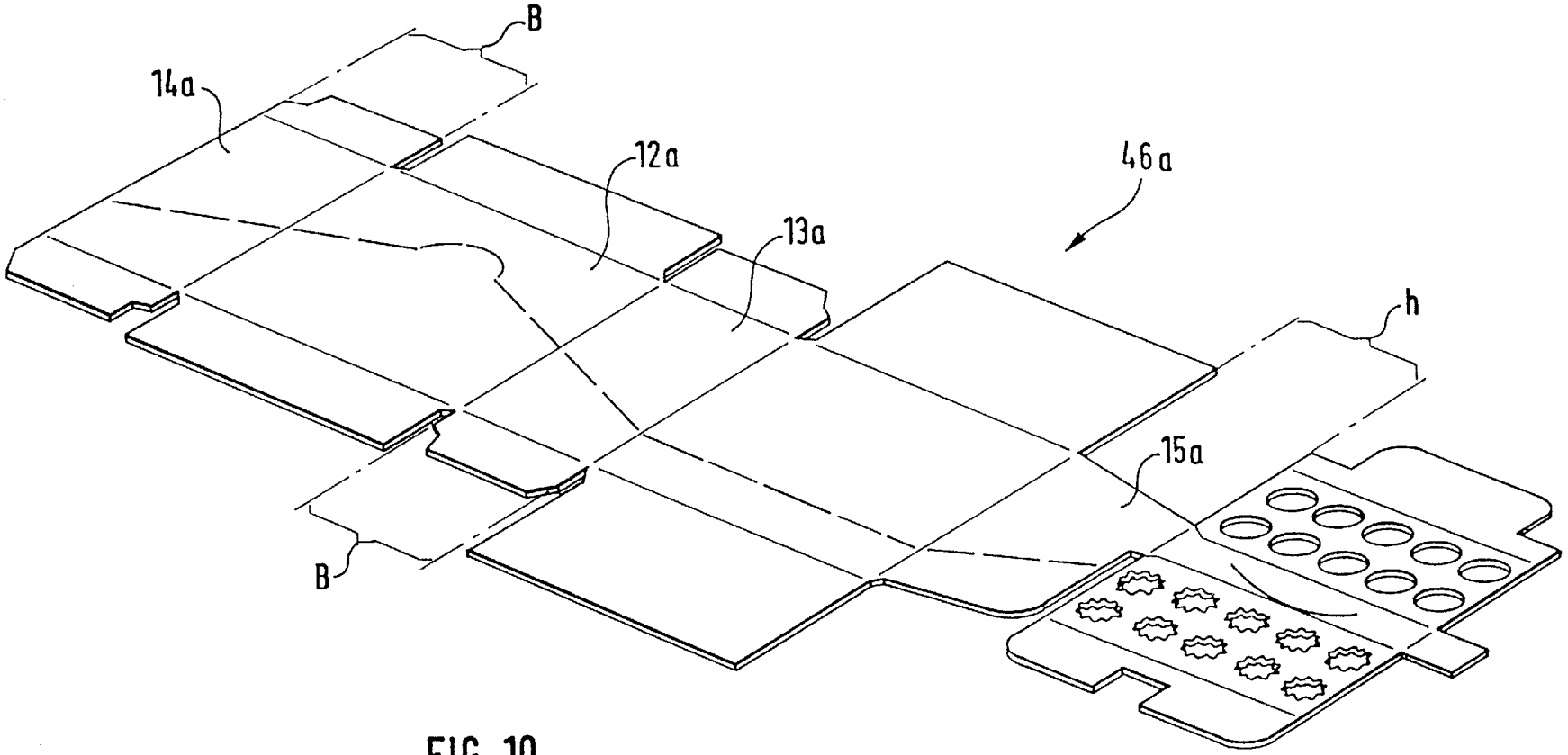
FIG. 10 shows a modified blank of the folding box compared with FIG. 3.

In FIG. 10, a second blank 46*a* of the folding box is shown. Once again, the (rough) inside is visible, or in other words is shown at the top. The (smooth) outside is underneath. The blank 46*a* is created by inverting the blank 46, and in addition the rough side is embodied as smooth while the smooth side, which is now the inside, is embodied as rough. As another difference, the height h of the longitudinal gluing flap 15*a* is now nearly equivalent to the width B of the short side walls 13*a*, 14*a*.

Figure 11:
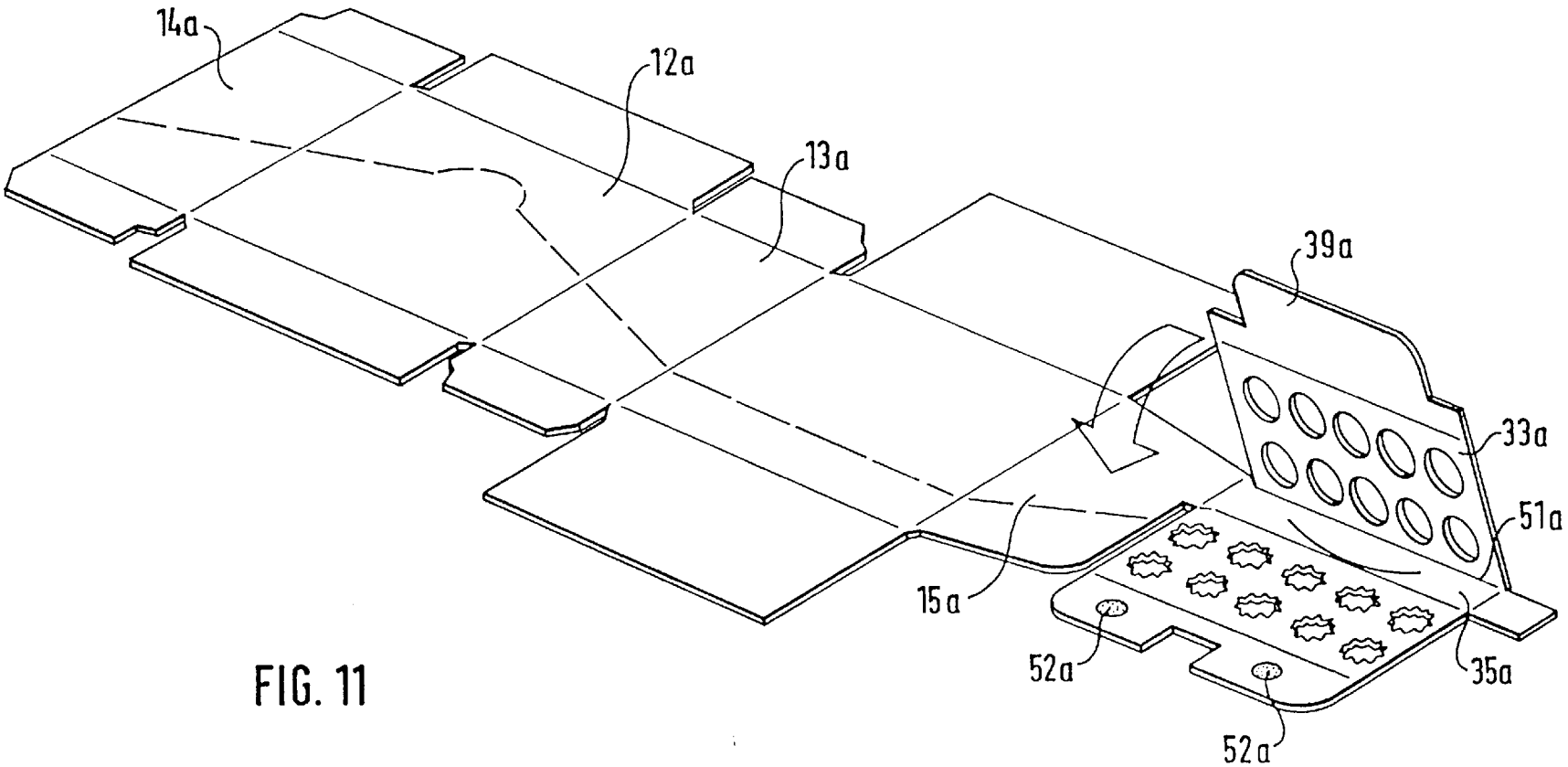
Figure 12:
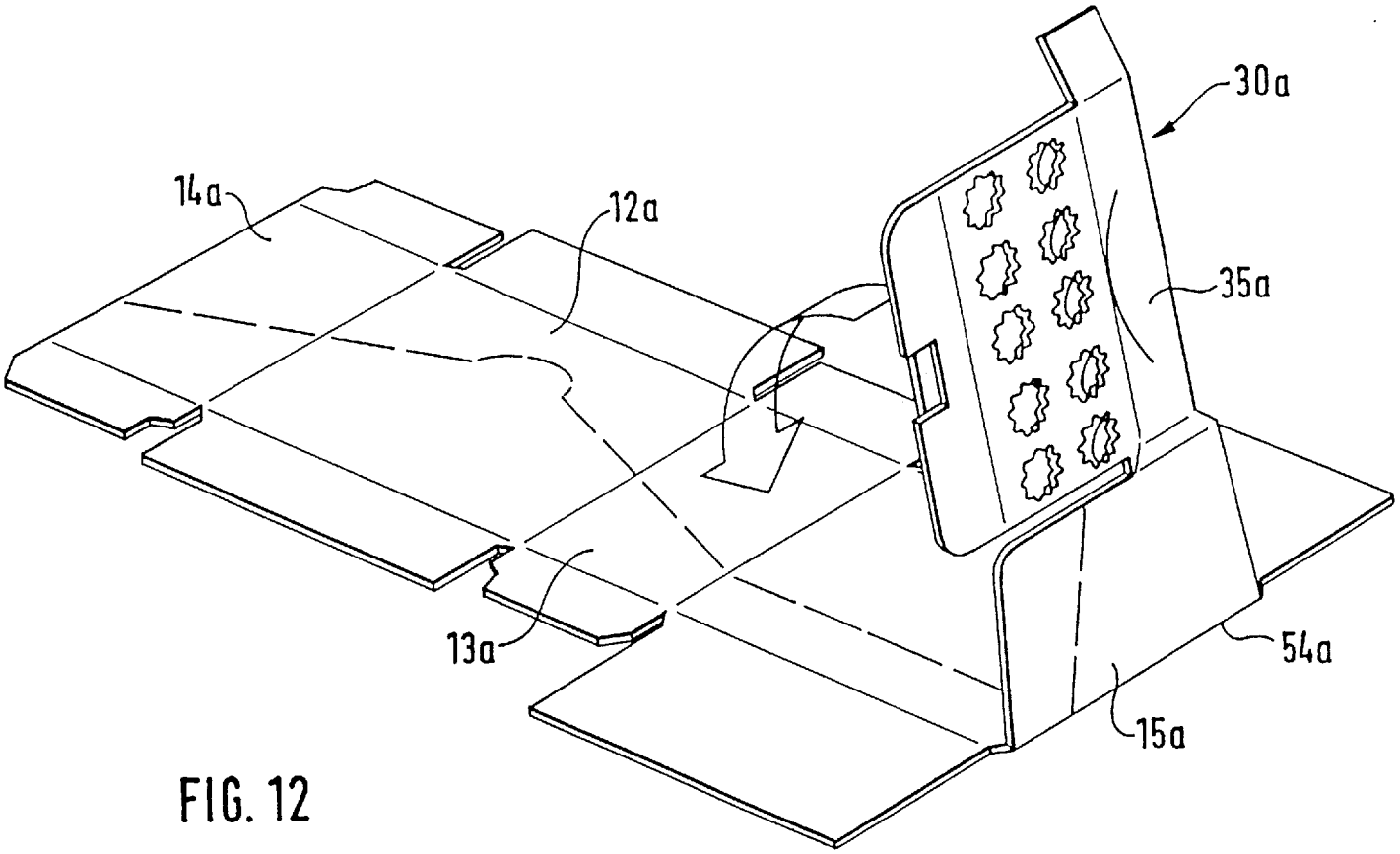

The production process of the folding box with the blank 46*a*, shown in FIGS. 11–14, begins as in the case of the blank 46 by folding over of the curtain wall 33*a* and the wide tab 39*a* on the fold line 51*a* of the web 35*a*. As with the blank 46, glue dots 52*a* are analogously provided (FIG. 11). Next, the web 35*a* together with the longitudinal gluing flap 15*a* is folded over on the fold line 54*a* (FIG. 12) without the application of glue dots. Finally, the side walls 12*a* and 14*a* are provided with glue dots 59*a*–59*d* and are folded over along a fold line 61, which joins the long side wall 12*a* to the short side wall 13*a* (FIGS. 13, 14).

The embodiment of the blank 46*a* and the modified folding operation employed has the advantage over the first folding box that the folding over of the insert 30*a* is now done on the fold line 54*a*, which is substantially wider than the fold line 53. As a result, better positioning of the inner frame 30*a* for the rest of the gluing operation can be attained. Another advantage is considered to be that the height h of the longitudinal gluing flap 15*a* is now nearly equivalent to the width B of the short side wall 14*a*. As a result, in the later erection of the insert 30*a* in a cartoning machine, the longitudinal gluing flap 15*a* can rest with its full surface against the inside of the short side wall 15*a*, and as a result the erecting process proceeds more reliably.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A one-piece blank for a folding box, comprising a rigid packaging material, such as cardboard, with two first side walls (11, 12) and with two second side walls (13, 13*a*, 14, 14*a*) for joining the first side walls; each of said side walls (11–14) having free ends, closure flaps (16–23) pivotably joined to the free ends of the side walls (11–14); two spaced-apart curtain walls (32, 33, 33*a*); a web (35, 35*a*) that joins the curtain walls (32, 33, 33*a*) to one another, the web (35, 35*a*) is joined to a first side wall (11) by means of an intermediate piece (15, 15*a*); the intermediate piece (15, 15*a*) is disposed on a side of the first side wall (11) opposite a second side wall (13, 13*a*); a short side (48) of the web (35, 35*a*) is pivotably joined to the intermediate piece (15, 15*a*), so that the long sides of the curtain walls (32, 33, 33*a*) extend parallel to the web (35, 35*a*).

2. The blank as defined by claim 1, in which the intermediate piece (15) has a height (h) which is less than a height (B) of the second side walls (13, 14); and that one tab (38, 39) is disposed on each of the sides of the curtain walls (32, 33) opposite the web (35).

3. The blank as defined by claim 1, in which the intermediate piece (15*a*) has a height (h) which is equivalent to a height (B) of the second side walls (13, 14); and that one tab (38, 39*a*) is disposed on each of the sides of the curtain walls (32, 33*a*) opposite the web (35*a*).

4. The blank as defined by claim 1, in which on a side of the web (35, 35*a*) opposite the intermediate piece (15, 15*a*), a further tab (47) is provided, said further tab can be joined to the second side wall (12) opposite the intermediate piece (15, 15*a*).

5. The blank as defined by claim 2, in which on a side of the web (35, 35*a*) opposite the intermediate piece (15, 15*a*), a further tab (47) is provided, said further tab can be joined to the second side wall (12) opposite the intermediate piece (15, 15*a*).

6. The blank as defined by claim 3, in which on a side of the web (35, 35*a*) opposite the intermediate piece (15, 15*a*), a further tab (47) is provided, said further tab can be joined to the second side wall (12) opposite the intermediate piece (15, 15*a*).

7. The blank as defined by claim 1, in which the intermediate piece (15, 15*a*) has a trapezoidal shaped blank.

8. The blank as defined by claim 3, in which the intermediate piece (15, 15*a*) has a trapezoidal shaped blank.

9. The blank as defined by claim 4, in which the intermediate piece (15, 15*a*) has a trapezoidal shaped blank.

10. The blank as defined by claim 5, in which the intermediate piece (15, 15*a*) has a trapezoidal shaped blank.

11. The blank as defined by claim 1, in which the first side walls are embodied as long side walls (11, 12), and the second side walls are embodied as short side walls (13, 13*a*, 14).

12. The blank as defined by claim 2, in which the first side walls are embodied as long side walls (11, 12), and the second side walls are embodied as short side walls (13, 13*a*, 14).

13. The blank as defined by claim 3, in which the first side walls are embodied as long side walls (11, 12), and the second side walls are embodied as short side walls (13, 13*a*, 14).

14. The blank as defined by claim 4, in which the first side walls are embodied as long side walls (11, 12), and the second side walls are embodied as short side walls (13, 13*a*, 14).

15. The blank as defined by claim 7, in which the first side walls are embodied as long side walls (11, 12), and the second side walls are embodied as short side walls (13, 13*a*, 14).

16. The blank as defined by claim 11, in which the first side walls are embodied as long side walls (11, 12), and the second side walls are embodied as short side walls (13, 13*a*, 14).

17. A folding box for packing articles, which comprises a rigid packing material such as cardboard, with two first side walls (11, 12) and with two second side walls (13, 13*a*, 14, 14*a*) for joining the first side walls; each of said side walls (11–14) having free ends, closure flaps (16–23) pivotably joined to the free ends of the side walls (11–14); two spaced-apart curtain walls (32, 33, 33*a*); a web (35, 35*a*) that joins the curtain walls (32, 33, 33*a*) to one another, the web (35, 35*a*) is joined to a first side wall (11) by means of an intermediate piece (15, 15*a*); the intermediate piece (15, 15*a*) is disposed on a side of the first side wall (11) opposite a second side wall (13, 13*a*); a short side (48) of the web (35, 35*a*) is pivotably joined to the intermediate piece (15, 15*a*), so that the long sides of the curtain walls (32, 33, 33*a*) extend parallel to the web (35, 35*a*).

18. A folding box for packing articles as set forth in claim 17, in which the intermediate piece (15) has a height (h) which is less than a height (B) of the second side walls (13, 14); and that one tab (38, 39) is disposed on each of the sides of the curtain walls (32, 33) opposite the web (35).

19. A folding box for packing articles as set forth in claim 17, in which the intermediate piece (15*a*) has a height (h) which is equivalent to a height (B) of the second side walls (13, 14); and that one tab (38, 39*a*) is disposed on each of the sides of the curtain walls (32, 33*a*) opposite the web (35*a*).

20. A folding box for packing articles as set forth in claim 17 in which on a side of the web (35/35*a*) opposite the intermediate piece (15, 15*a*), a further tab (47) is provided, said further tab can be joined to the second side wall (12) opposite the intermediate piece (15, 15*a*).

21. A folding box for packing articles as set forth in claim 17, in which the first side walls are embodied as long side walls (11, 12), and the second side walls are embodied as short side walls (13, 13*a*, 14).

* * * * *